US005300382A

United States Patent [19]

Takeda

[11] Patent Number: 5,300,382

[45] Date of Patent: Apr. 5, 1994

[54] FULL-COLOR IMAGE FORMING APPARATUS WITH TWO SIDE CAPABILITY AND TWO-SIDE FULL-COLOR IMAGE FORMING METHOD

[75] Inventor: Kenji Takeda, Yokohama, Japan

[73] Assignee: Canon Kabushiki Kaisha, Tokyo, Japan

[21] Appl. No.: 863,089

[22] Filed: Apr. 3, 1992

[30] Foreign Application Priority Data

Apr. 5, 1991 [JP] Japan ..... 3-099760

[51] Int. Cl.[5] ..... G03G 15/01

[52] U.S. Cl. ..... 430/42; 355/319; 430/99

[58] Field of Search ..... 430/99, 42; 355/285, 355/319

[56] References Cited

U.S. PATENT DOCUMENTS 3,904,786 9/1975 Takiguchi ..... 430/99

5,124,756 6/1992 Stelter ..... 355/290

*Primary Examiner*—John Goodrow

*Attorney, Agent, or Firm*—Fitzpatrick, Cella, Harper & Scinto

[57] ABSTRACT

A two-side image forming method apparatus and related method, the method including steps of: forming a multi-color image on one side of a recording material; heating the recording material, bearing the multi-color image on a side thereof, with a first amount of heat; forming a multi-color image on the other side of the recording material heated with the first amount of heat; and heating said recording material, bearing the multi-color images on both sides thereof with a second amount of heat larger than the first amount of heat.

14 Claims, 5 Drawing Sheets

ROTATION SPEED : LARGE

ROTATION SPEED : SMALL

ROTATION SPEED : MEDIUM

FULL-COLOR IMAGE FORMING APPARATUS WITH TWO SIDE CAPABILITY AND TWO-SIDE FULL-COLOR IMAGE FORMING METHOD

BACKGROUND OF THE INVENTION

1. Field of the Invention

The present invention relates to an image forming apparatus such as a copying machine or a laser beam printer and more particularly to an image forming apparatus capable of forming multi-color images on both sides of a recording material.

2. Related Background Art

In the image forming apparatus designed for forming a monochromatic (for example black-and-white) image, such as the copying machine, it is already widely conducted to form the images on both sides of the recording material, in view of saving the resources and the space for image output. In a two-side copying machine, an image is at first formed and fixed on one side of the recording material, and then another image is formed and fixed on the other side of the recording material.

On the other hand, with the increase in complexity, diversity, and amount of information in recent years, the use of colored image is spreading and there is emerging a demand for forming full-color images on both sides of the recording material. However, such formation of full-color images on both sides of the recording material will result in perturbation of the image if the conventional method for monochromatic image is applied.

More specifically, in the formation of a full-color image, the desired color is obtained by mixing, by fusion under heating with fixing means, powered toner images of plural colors provided on the recording material. If an image is formed with this method on the first side of the recording material and another image is then formed in a similar manner on the second side, the heat applied at the fixation of the image on the second side is transmitted to the first side, whereby the properly mixed image on the first side is excessively fused and becomes defective.

Also, even if an adequate amount of heat is supplied to the second side from the fixing device, the multi-color image already formed on the first side takes away a part of said heat, so that the color mixing and fixation of the image on the second side cannot be conducted sufficiently, and a satisfactory image cannot therefore by formed also on the second side.

SUMMARY OF THE INVENTION

In consideration of the foregoing, an object of the present invention is to provide an apparatus and a method enabling the formation of full-color images on both sides of a recording material.

Another object of the present invention is to provide an apparatus and a method, in the formation of full-color images on both sides of a recording material, for providing the recording material with a larger amount of heat at the image fixation on the second side than for the first side.

Still another object of the present invention is to provide an apparatus and a method, in the formation of full-color images on both sides of a recording material, for providing the recording material with an amount of heat, for image fixation on the first side, smaller than that for fixation of a one-side image, and with an amount of heat, for image fixation on the second side, larger than that for fixation of a one-side image.

Still other objects of the present invention will become fully apparent from the following description.

DETAILED DESCRIPTION OF THE PREFERRED EMBODIMENTS

In the discussion there will be explained a first embodiment of the present invention, with reference to FIGS. 1A to 4.

Figure 3:
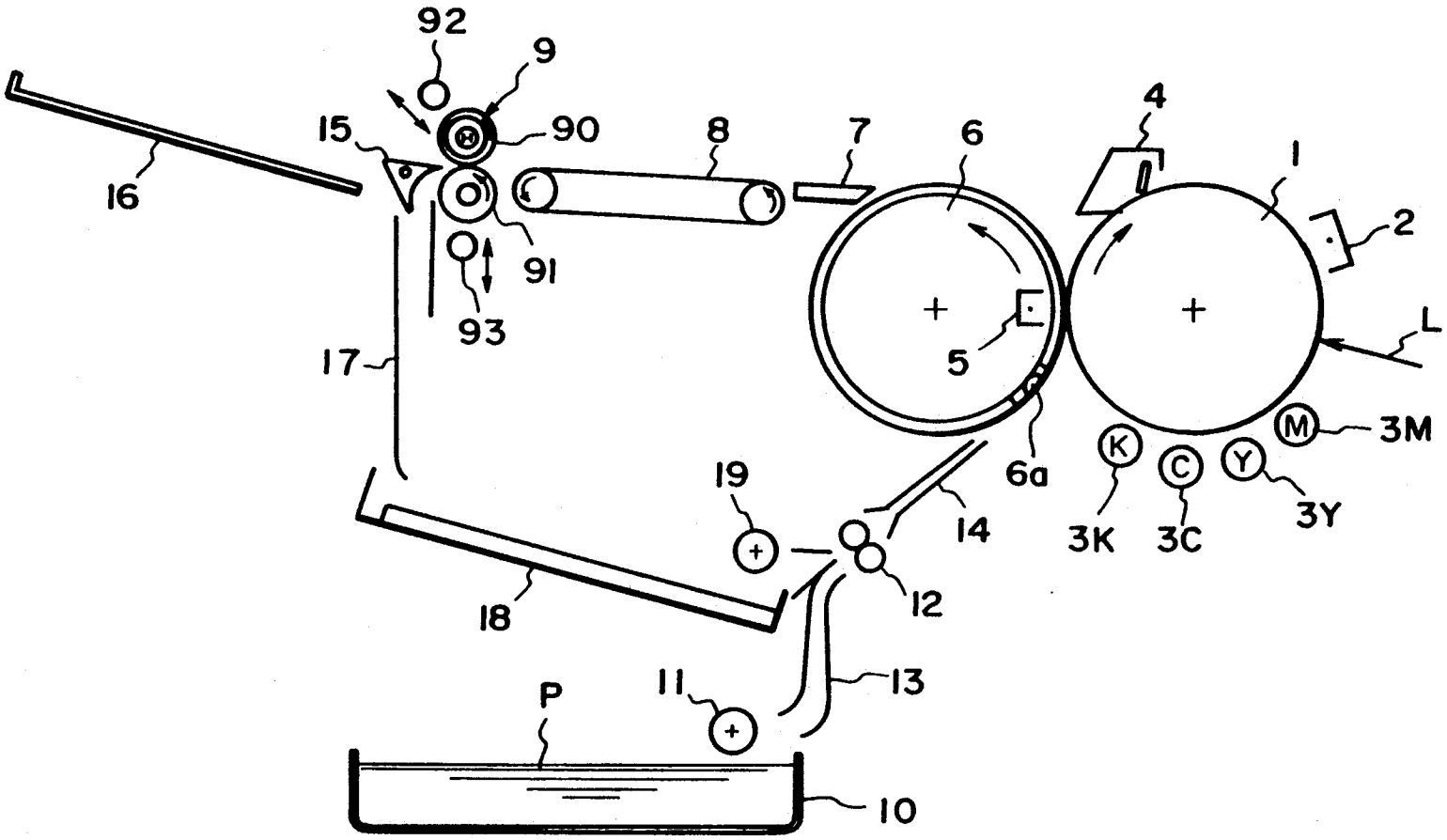
FIGS. 3 is a schematic view showing the arrangement of principal components of prior image forming apparatus.

FIG. 3 shows the arrangement of principal components of an image forming apparatus capable of forming multi-color images on both sides (hereinafter called "first side Pa" and "second side Pb") of a transfer or recording material P. A photosensitive drum 1 rotated in a predetermined direction constitutes an image bearing member, around which are provided a primary charger 2, developing units 3M, 3Y, 3C and 3K respectively for magenta, yellow, cyan and black colors, and a cleaning unit 4.

At the side of said photosensitive drum, there is provided a transfer drum 6, which supports the recording material P by a grip **6*a* and transfers the toner image formed on the photosensitive drum 1 onto said recording material P by the function of a transfer charger 5 provided inside said transfer drum 6. At the sheet discharge side of said transfer drum 6 there are provided a separating finger 7, a conveyor unit 8 and a fixing unit 9, while, at the sheet feeding side there are provided a sheet cassette 10, a sheet feeding roller 11, registration rollers 12 and first and second guide members 13, 14. Also at the sheet discharge side of the fixing unit 9 there is provided an inverting guide 15 for forwarding the recording material P either to a sheet discharge tray 16 or to a transport tray composed of a third guide member 17, an intermediate tray 18 and a feeding roller 19**.

The fixing unit 9 is provided with a fixing roller 91 provided therein with a heater H and rotated in a predetermined direction, a pressure roller 91 rotated in pressure contact with said fixing roller 90, and first and second applicator rollers 92, 93 which can be contacted with or separated from the rollers 90, 91 and can apply thereto a releasing agent, such as oil. The pressure roller 90 is not provided with a heater.

Figure 4:
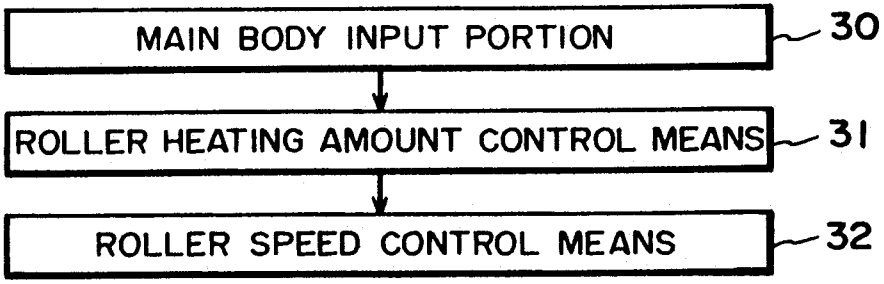
FIG. 4 is a view showing the control system of the fixing device of prior image forming apparatus.

In the main body of the image forming apparatus there are provided, as shown in FIG. 4, a main body input unit 30 for entering the kind of image to be formed (single or multiple colors) and whether the image forming unit forms the image on one or both sides of the recording material P; roller heating amount control means 31 for varying the amount of heating of the recording material P according to whether multi-color images are formed on both sides of the recording material P; and a roller speed control unit 32 for varying the rotating speed of the fixing and pressure rollers 90, 91, thereby varying the amount of heating of the recording material P in response to the signal from said roller heating amount control means 31.

In case of forming multi-color images on both sides of the recording material P, the roller heating amount control means 31 sends the signal to the roller speed control unit 32 in such a manner that the amount of heating by the fixing roller 90 at the fixation of the image on the second face Pb of the recording material P becomes larger than that for the image on the first face Pa, and that the amount of heating by the fixing roller 90 at the fixation of the image on the first face Pa is smaller than that in case of image formation on one side only.

At first, there will be explained functions of the image forming apparatus in case of forming a full-color image on one side (first side Pa) only of the recording material P. Referring to FIG. 3, the photosensitive drum 1, uniformly charged with the primary charger 2, is exposed to the light L corresponding to the magenta information from a scanner unit (not shown), whereby an electrostatic latent image based on said magenta information is formed on said photosensitive drum 1 and is developed, by the magenta developing unit 3M containing magenta toner, into a visible magenta toner image. Said toner image is transferred onto the recording material P supported on the transfer drum 6, by the function of the transfer charger 5.

After the image transfer, the photosensitive drum 1 is cleaned by the cleaning device 4 and is again uniformly charged by the primary charger 2. The photosensitive drum 1 is exposed to the light corresponding to the yellow information from the scanner unit to form an electrostatic latent image. The latent image is developed, by the yellow developing unit 3Y containing yellow toner, into a visible yellow toner image, which is in overlapping manner transferred onto the magental toner image supported on the recording material P on the transfer drum 6. Similarly, toner images formed in succession on the photosensitive drum 1 by the cyan developing unit 3C containing cyan toner and the black developing unit 3K containing black toner are transferred in overlapping manner onto the recording material P on the transfer drum 6.

On the other hand, the recording material P, advanced, one by one, by the feed roller 11 from the cassette 10, is transported through the first guide members 13 toward the registration rollers 12, and, after adjustment of timing by said registration rollers 12, advanced through the second guide members 14 toward the transfer drum 6. The recording material P is positioned on and supported by the grip 6*a* on the transfer drum 6, and is subjected to the multiple transfers of toner images from the photosensitive drum 1, along with the rotation of the transfer drum 6. After said image transfers, the recording material P is separated from the transfer drum 6 by the separating finger 7, then transported by the conveyor unit 8 to the fixing device 9 and is subjected to the fixation of toner image in said fixing device 9.

When the recording material P is transported into the fixing device 9, the toner images on said recording material P are heated and pressed by the fixing and pressure rollers 90, 91, thereby being fused and mixed, and are fixed onto the recording material P in an appropriate color by cooling after passing through said rollers 90, 91. In this operation, the first applicator roller 92 is maintained in contact with the fixing roller 90 for applying the releasing agent. After said toner image fixation, the recording material P is advanced through the inverting guide 15 and is stacked on the discharge tray 16.

In the following discussion, there will be explained the functions of this image forming apparatus in the case of forming full-color images on both sides of the recording material P. The recording material P, bearing multi-color toner images on the first face Pa as explained above, is transported to the fixing device 9 for heat fixation of said toner images. In this case, however, a signal indicating the formation of multi-color images on both sides of the recording material 30 is entered in advance by the operator into the input unit 30, whereby the roller heating control means 31 controls the roller speed control means 32 so as to increase the rotating speed of the rollers 90, 91 compared with the speed the ordinary case. For this reason, the recording material P emerges from the fixing device 9 in a semi-fixed state in which the toner images are not sufficiently fused and mixed because of somewhat deficient heating.

Said recording material P is then transported through the third guide members 17 and temporarily stacked on the intermediate tray 18. Subsequently said recording material P is advanced by the feed roller 19 toward the registration rollers 12, then, after adjustment of timing by said registration rollers 12, advanced to the transfer drum 6 and supported thereon with the second side Pb without the image outside. After multiple transfers of the toner images in a similar manner on said second side Pb, the recording material P is transported to the fixing device 9 for heat fixing of said toner images on the second side Pb.

In this case, the roller heating control means 31 controls the roller speed control means 32 to somewhat decrease the rotating speed of the rollers 90, 91 whereby the recording material P receives an amount of heat larger than in the normal situation. However, since the recording material P bears not only multi-color toner images on the second side Pb but also on the rear first side Pa, the excessive heat after fixation of the toner image on the second side Pb is directed to that on the first side Pa which has been in insufficiently fused and mixed state due to somewhat deficient heating, whereby said image on the first side Pa is sufficinetly mixed and developed into a proper color by said excessive heat. After such proper fixation of the toner images on the first and second sides Pa, Pb, the recording material P is advanced through the inverting guide 15 and stacked on the discharge tray 16.

In the following discussion, there will be explained, with reference to FIGS. 1A to 2B, the mechanism of formation of proper multi-color images on both sides of the recoridng material P, through variations of the amount of heating by the fixing device 9.

Figure 2A:
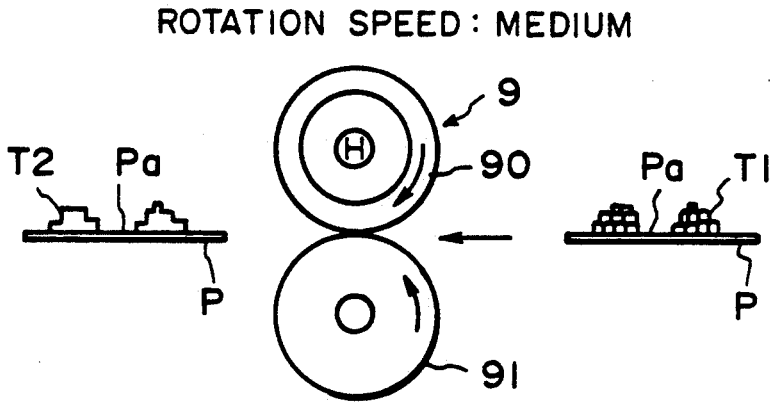
FIGS. 2A and 2B are schematic views showing the function of a fixing device of a conventional image forming apparatus.
Figure 2B:
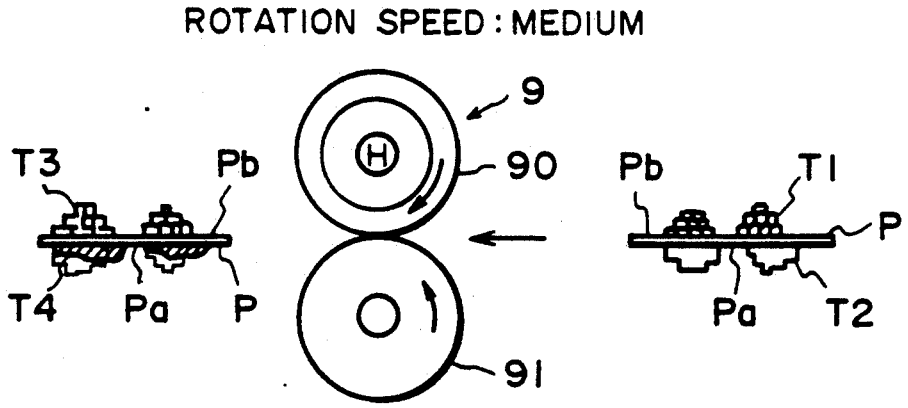

At first, reference is made to FIGS. 2A and 2B for explaining the situation in a fixing device 9 in a conventional image forming apparatus. In the image formation on the first side Pa of the recording material P, an unfixed toner image T1 on the recording material P is, as shown in FIG. 2A, properly fused and mixed to form a fixed toner image T2 under the application of a normal heat amount by the ordinary rotating speed of the fixing roller 90. Then, if an unfixed toner image T1 is formed on the second side Pb of the recording material P which already has the fixed toner image T2 on the first side Pa and is subjected to the fixation in the fixing deivce 9 as shown in FIG. 2B, the amount of heat supplied to said unfixed toner image T1 on the second side Pb becomes deficient because of the enlarged total heat capacity of the recording material P due to the presence of the fixed toner image T2 on the first side Pa, whereby, after passing the fixing device 9, the toner image on the second side Pb becomes a semi-fixed toner image T3 with incomplete fusing. Also, the properly fixed toner image T2 on the first side Pa receives heat thereby undergoing excessive fixation, and becomes an excessive fixed toner image T4 showing excessively fusion and flow of toner. Therefore, a satisfactory image connot be obtained on either side of the recording material P.

Figure 1A:
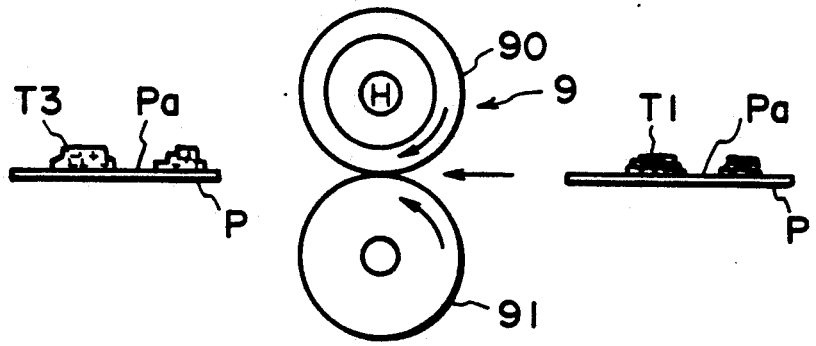
FIGS. 1A, 1B and 1C are schematic views showing the function of a fixing device in a first embodiment of the image forming apparatus of the present invention.
Figure 1B:
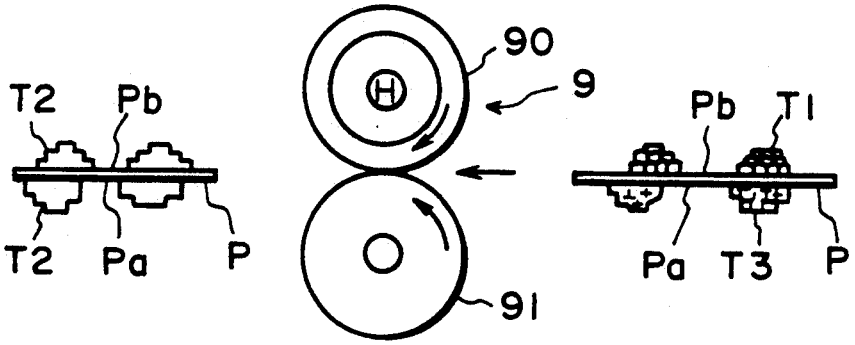
Figure 1C:
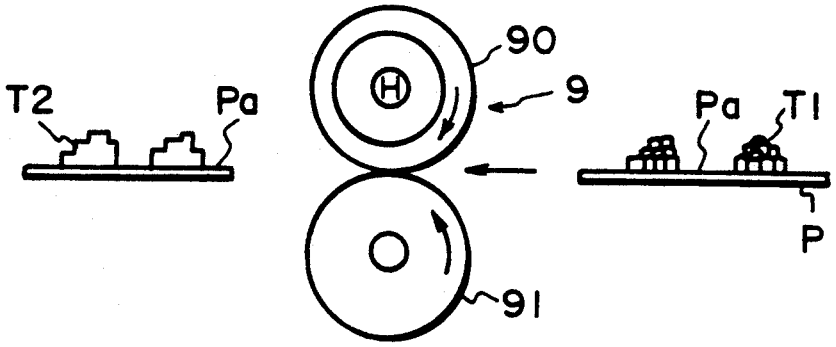

The function of the fixing device 9 of the image forming apparatus of the present invention is shown in FIGS. 1A, 1B and 1C. In the fixation of an unfixed toner image T1 formed on the first side Pa of the recording material, the rotating speed of the fixing roller 90 is somewhat increased to slightly reduce the amount of heat applied by the fixing device 9 as shown in FIG. 1A, whereby the unfixed toner image T1 becomes a semi-fixed toner image T3 with deficient fusion. Then, an unfixed toner image T1 is formed on the second side Pb of said recording material P, already having a semi-fixed toner image T3 on the first side Pa, as shown in FIG. 1B and is subjected to the fixation in the fixing device 9. This fixation is conducted with a somewhat lowered rotating speed of the fixing roller 90 to increase the amount of heat supplied by the fixing device 9, whereby the unfixed toner image T1 on the second side Pb is properly heated to form a fixed toner image T2, and the semi-fixed toner image T3 on the first side Pa also receives heat thereby becoming a properly fixed toner image T2.

Also in the fixing device 9 of the image forming apparatus of the present invention, in case of image formation only on one side, the unfixed toner image T1 on the recording material can naturally be properly fixed as the fixed toner image T2 as shown in FIG. 1C by rotating the fixing roller 90 at the ordinary rotating speed, thereby applying the ordinary amount of heat from the fixing device 9.

As explained in the foregoing, in the present invention, in case of forming multi-color images on both sides of the recording material P, the amount of heat supplied by the fixing device 9 is varied for the toner image on the first side Pa of said recording material P and for that on the second side Pb, whereby the toner images on the first and second sides can be properly heated and fixed.

Figure 5:
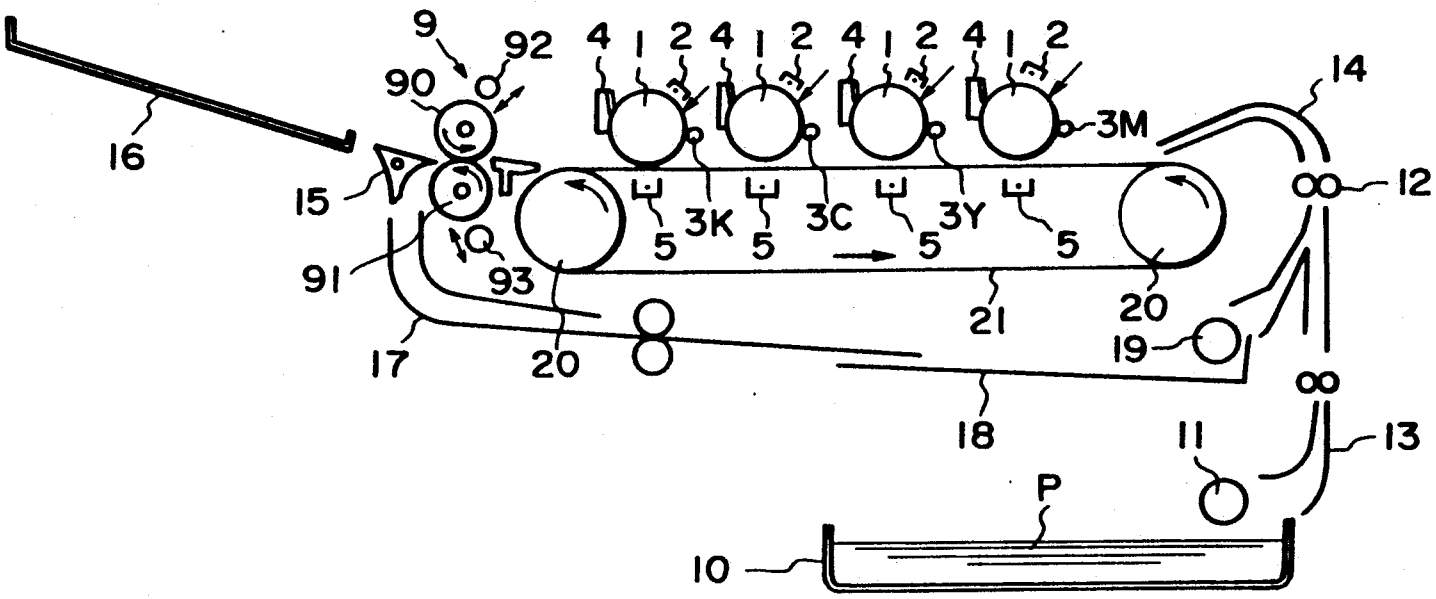
FIG. 5 is a schematic view showing the arrangement of principal components of a second embodiment of the image forming apparatus of the present invention.
Figure 6:
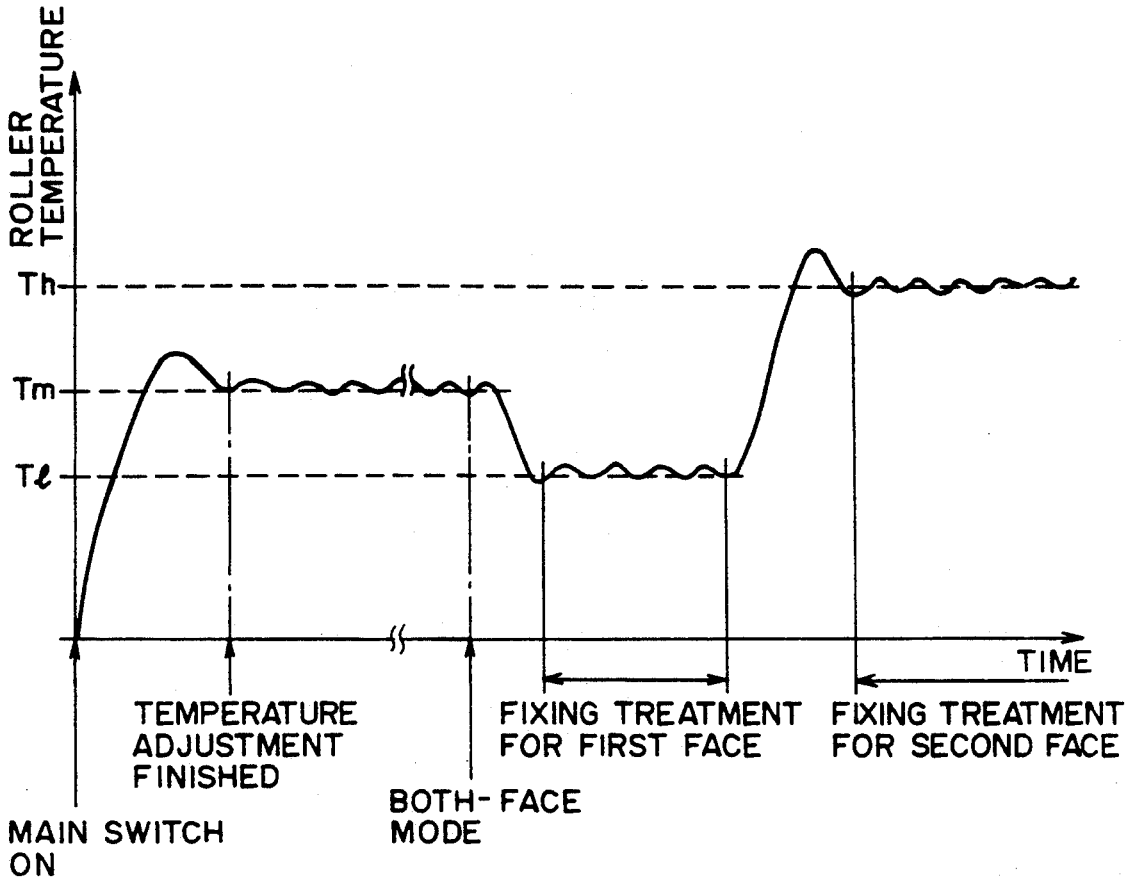
FIG. 6 is a chart showing the temperature control state of a fixing roller in a fixing device of said image forming apparatus.
Figure 7:
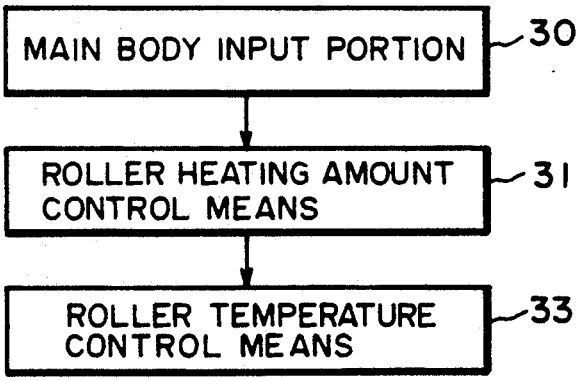
FIG. 7 is a view showing the control system of the fixing device of said image forming apparatus.

In the following, there will be explained a second embodiment of the present invention, with reference to FIGS. 5 to 7, wherein components equivalent in function to those in the first embodiment are represented by same numbers and will not be explained further.

In the image forming apparatus of the present embodiment, along an endless transfer belt 21 rotatably supported between two rollers 20, there are provided four photosensitive drums 1, around which provided are chargers 2, developing units 3M, 3Y, 3C and 3K of magenta, yellow, cyan and black colors, cleaning units 4, and transfer chargers 5. Toner images of magenta, yellow, cyan and black images are respectively formed on said photosensitive drums 1, and are transferred in overlapping manner onto the recording material P fixed on and moving with the transfer belt 21.

Also in such image forming apparatus, in case of forming multi-color images on both sides of the recording material P, satisfactory image formations as in the first embodiment can be achieved by somewhat decreasing the amount of heating by the fixing device 9 for the toner image on the first side Pa and somewhat increasing the amount of heating for the toner image on the second side Pb.

In the fixing device 9 of the present embodiment, the adequate variation in the rotating speed of the fixing roller 90 is difficult because of the limited distance between said fixing device 9 and the transfer belt 21. For this reason, the amount of heating by the fixing device 9 is regulated by the surface temperature of the fixing roller 90. When a main switch of the main body of the image forming apparatus is turned on, the surface temperature of the fixing roller 90 of the fixing device 9 is controlled at a temperature Tm suitable for ordinary one-side image fixation. However, if the two-side mode, for forming multi-color images on both sides, is entered into the input unit 30, the surface temperature of the fixing roller 90 is lowered to T1 at the fixation of the toner images on the first side Pa of the recording material P and is elevated to Th at the fixation of the toner images on the second side Pb.

Thus, a signal from the input unit 30 is transmitted to the roller heating amount control means 31, which in turn send a signal to the roller temperature control means 33 thereby controlling the surface temperature of the fixing roller 90.

In the foregoing first and second embodiments, the recording material P is assumed to be plain paper, but the present invention is naturally likewise applicable when said recording material P is composed of cardboard or a plastic film such as polyester film.

The present invention is not limited by the foregoing embodiments but is subject to any and all modifications within the scope and spirit of the appended claims.

What is claimed is:

1. A two-side image forming method comprising steps of:

forming a multi-color image on one side of a recording material; first heat-fixing the recording material bearing the multi-color image on one side of the recording material;

forming a multi-color image on the other side of the recording material; and second heat-fixing the recording material bearing the multi-color images on both sides of the recording material, wherein an amount of heat supplied to said recording material during said first heat-fixing is smaller than that amount of heat supplied for forming a multi-color image on only one side of the recording material.

2. A method according to claim 1, wherein an amount of heat supplied to said recording material during said second heat-fixing is larger than an amount of heat supplied during said first heat-fixing.

3. A method according to claim 2, wherein the amount of heat supplied to the recording material during said second heat-fixing is larger than the amount of heat supplied to the recording material for forming a multi-color image on only one side of the recording material.

4. A method according to claim 1, wherein the recording material is heated by a heater only from a side of the recording material bearing an unfixed multi-color image thereon.

5. A method according to claim 4, wherein the recording material, bearing said multi-color image or images thereon, is heated when pinched and transported by a rotary heating member heated by a heater and a rotary pressurizing member which forms a nip in cooperation with said rotary heating member.

6. A method according to claim 5, wherein a rotating speed of the rotary heating member during said first heat-fixing is larger than a rotating speed for forming a multi-color image on only one side of the recording material.

7. A method according to claim 5, wherein the surface temperature of the rotary heating member supplied during said first heat-fixing is lower than the surface temperature of the rotary heating member supplied for forming a multi-color image on only one side of the recording material.

8. A full-color image forming apparatus comprising:

image forming means for forming a multi-color image on a recording material;

fixing means for heat-fixing the multi-color image on the recording material; and transport means for transporting the recording material, subjected to fixing in said fixing means, to the image forming means to form an image on an inverted image bearing side of the recording material;

wherein upon forming the multi-color image on both sides of the recording material, an amount of heat supplied to said fixing means to a first side of the recording material is smaller than an amount of heat required for forming a multi-color image on only one side of the recording material.

9. An apparatus according to claim 8, wherein the amount of heat supplied by said fixing means to a second side of the recording material required for forming the multi-color image on both sides of the recording material is larger than an amount of heat required for forming a multi-color image on only one side of the recording material.

10. An apparatus according to claim 9, wherein the amount of heat supplied by said fixing means to the recording material at the image fixation on the second side is larger than an amount of heat supplied to the recording material at the formation of an image on only one side of the recording material.

11. An apparatus according to claim 8, wherein said fixing means is provided with a fixing heater only at a side, bearing an unfixed multi-color image, of the recording material.

12. An apparatus according to claim 11, wherein said fixing means includes a rotary heating member heated by a heater, and a rotary pressurizing member forming a nip in cooperation with said rotary heating member.

13. An apparatus according to claim 12, wherein a rotating speed of the rotary heating member during the image formation at the first side of the recording material upon forming a multi-color image on both sides of the recording material is larger than a rotating speed upon forming a multi-color image on only one side of the recording material.

14. An apparatus according to claim 12, wherein a surface temperature of the rotary heating member of the first side of the recording material provided for forming the multi-color image on both sides is lower than a surface temperature of the rotary heating member provided for forming the multi-color image on only one side of the recording material.

* * * * *

UNITED STATES PATENT AND TRADEMARK OFFICE

CERTIFICATE OF CORRECTION

PATENT NO. : 5,300,382

DATED : April 5, 1994

INVENTOR(S) : KENJI TAKEDA

It is certified that error appears in the above-identified patent and that said Letters Patent is hereby corrected as shown below:

ON TITLE PAGE & Column 1, line 2§

In [54] Title, "TWO SIDE" should read --TWO-SIDE--.

In [57] ABSTRACT, Line 1, "method" should be deleted.

COLUMN 1

Line 3, "TWO SIDE" should read --TWO-SIDE--.
Line 19, "In" should read --In such--.

COLUMN 2

Line 29, "the discussion" should read --the following discussion,--.

COLUMN 3

Line 45, "magental" should read --magenta--.

COLUMN 4

Line 24, "the speed" should read --the speed in--.
Line 52, "sufficinetly" should read --sufficiently--.

COLUMN 5

Line 17, "excessively" should read --excessive--.

UNITED STATES PATENT AND TRADEMARK OFFICE

CERTIFICATE OF CORRECTION

PATENT NO. : 5,300,382

DATED : April 5, 1994

INVENTOR(S) : KENJI TAKEDA

It is certified that error appears in the above-identified patent and that said Letters Patent is hereby corrected as shown below:

COLUMN 6

Line 46, "first" should read --¶ first--.

COLUMN 8

Line 26, "at" should read --on--.

Signed and Sealed this

Eighteenth Day of October, 1994

Bruce Lehman

*Attest:*

BRUCE LEHMAN

*Attesting Officer*

*Commissioner of Patents and Trademarks*